US006098669A

United States Patent [19]

Klöcker et al.

[11] Patent Number: 6,098,669

[45] Date of Patent: Aug. 8, 2000

[54] DEVICE FOR PRODUCING A LENO SELVEDGE, IN PARTICULAR FOR SHUTTLELESS LOOMS

[75] Inventors: Matthias Klöcker; Christoph Schwemmlein; Kurt Hockemeyer, all of Borken-Weseke, Germany

[73] Assignee: Klocker-Entwicklungs - GmbH, Germany

[21] Appl. No.: 09/077,789

[22] PCT Filed: Oct. 3, 1996

[86] PCT No.: PCT/DE96/01908

§ 371 Date: Jun. 5, 1998

§ 102(e) Date: Jun. 5, 1998

[87] PCT Pub. No.: WO97/24480

PCT Pub. Date: Jul. 10, 1997

[30] Foreign Application Priority Data

Dec. 28, 1995 [DE] Germany ..... 195 48 955

[51] Int. Cl.[7] ..... D03C 7/08; D03C 7/04

[52] U.S. Cl. ..... 139/54

[58] Field of Search ..... 139/54

[56] References Cited

U.S. PATENT DOCUMENTS

| | | | |
|---|---|---|---|
| 2,918,092 | 12/1959 | Paabo . | |
| 4,166,428 | 9/1979 | Muller . | |
| 5,518,039 | 5/1996 | Haeussler et al. . | |
| 5,524,678 | 6/1996 | Haeussler et al. | 139/54 |

FOREIGN PATENT DOCUMENTS

| | | |
|---|---|---|
| 128364 | 6/1900 | Germany . |

*Primary Examiner*—Andy Falik
*Attorney, Agent, or Firm*—McDermott, Will & Emery

[57] ABSTRACT

Device for producing a leno selvedge, in particular for a loom, including an electromotor with a rotor, whereas the rotor has at least two spaced guide elements for the leno threads, whereas the guide elements are designed as being elastic and flexible so that they can compensate fluctuations in thread tension in direction of the electromotor's, axis.

10 Claims, 3 Drawing Sheets

DEVICE FOR PRODUCING A LENO SELVEDGE, IN PARTICULAR FOR SHUTTLELESS LOOMS

BACKGROUND OF THE INVENTION

1. Field of the Invention.

This invention relates to a device for producing a leno selvedge, in particular for a loom, including an electromotor with a rotor, whereas the rotor has at least two spaced guide elements for the leno threads.

2. Description of the Prior Art.

A device for producing a leno selvedge is known out of FR-A 23 90 524, this device having arms being elastic and flexible in axial direction. This device is a so-called "planet rotator." Due to its design, such a planet rotator has a high mass, still increased by the fact that this known planet rotator has the spools for the leno threads arranged directly on the rotator. That means that such a device has a mass so big that it is physically impossible to accelerate and slow down in short time intervals.

The same applies to DE-A 15 35 579 which also shows a so-called planet rotator. This device too is incapable of fast acceleration and fast slowing down due to the movable mass. No other evaluation can be made of U.S. Pat. No. 2,918,092 since the device also associates the yarn spools with its movement.

A device as mentioned above is known out of DE-PS 44 05 776. Hereby, an electrically drivable servomotor is provided which drives a doup disc, the doup disc forming the rotor of the electrically drivable servomotor. The stator itself is mountable onto the loom by means of a carrying element, preferably in a free space between the longitudinal braces and the healds in front to the first heald frames of the loom. More particularly the doup disc, which forms the rotor of the electrically drivable servomotor, has two opposite openings through which one leno thread at a time is led, these openings serving as guide elements. This known rotator for producing a leno selvedge in a loom works so that it completes several hundred revolutions in one direction and ties off one weft thread after each revolution. A full leno selvedge is thus achieved. On the feeding side of the two leno threads, the leno threads are twisted according to the number of revolutions of the doup disc so that, in order to undo this twisting, an inversion of the douping direction is indicated, the douped disc having to rotate in exactly the opposite direction. The number of revolutions in either direction has hereby to be the same in an average period of time. If the douping direction were not inverted, the leno threads would, some time or other, tear due to the increasing tension occasioned by the growing twisting.

In case of the known fast-running looms making up to 1200 werfts per minute, it was ascertained that after approximately 100 to 1000 revolutions in one direction an inversion of the douping direction should occur. That means that, according to the state of the art, the rotor and thus the douping disc of the electrically drivable servomotor has to be reversed every 10 to 100 second. Due to the number of strokes of a loom, the time available for inversion is of 100 millliseconds (msec) maximum. That means that the rotor of the motor has to stand still and to rotate in the reversed douping direction at full speed within 100 msec. Due to the high mass of the douping disc and of the rotor respectively, this performance can be achieved with known motors only at high cost. The idea to reduce the moved mass of the motor by choosing a rightaway smaller motor will naturally arise. The danger incurred in this case is that, if the rotor and thus the douping disc are given a smaller diameter, the shedding occurring between the two leno threads guided through the douping disc is not sufficient, so that the weft thread cannot be inserted accurately. Moreover, the threads can still stick together, impeding the formation of a clean selvedge.

Moreover, during the rotation of the guide elements, the thread tension of the leno threads guided through the guide elements fluctuates. The fluctuations depend on the thread length of the leno threads, themselves depending on the douping angle and on the coning angle of the device relative to the loom. The fluctuations in the thread tension may bring sensitive yarns to tear.

SUMMARY OF THE INVENTION

The object of the invention is therefore to develop a device of the above-mentioned type, so that on one hand it has a small mass in order to be able to produce a correct full leno selvedge even in fast running looms, and that it additionally is able to compensate fluctuations in the thread tension of the leno threads, avoiding thus the tear of the threads.

The solution of the object is to design the guide elements as arms provided at their ends with eyes through which the leno threads are passed, the arms being elastic and flexible in axial direction of the electromotor in order to compensate the thread tensions.

Thanks to the elastic flexibility of the guide elements in the axial direction of the rotating element and to the corresponding deformation of the guide elements, the otherwise occurring fluctuations in thread tension of the leno threads are compensated.

To untwist the leno threads, the rotating direction of the rotor of the electromotor is invertable.

The elastic and flexible arms are advantageously provided at their ends with eyes through which the leno threads are passed. The arms themselves can be of light design, since they are hardly ever subjected to stress. They thus represent a relatively neglectable mass. That means that a small motor with a correspondingly smaller rotor can be chosen, the mass being accordingly small, since, due to the arrangement of the arms on the rotor, the technical designer is now free, except for the output requirements, to choose the size and the diameter of the motor. That's why motors with a small diameter and with accordingly small moved masses can be used without risking to impede a correct shed aperture, since the length of the arms arranged on the rotor permits to choose freely the spacing of the eyes in the arms and thus the size of the shed aperture. Thus it is also possible to untwist the leno threads by designing the rotor so that its rotating direction is invertable.

The arms are arranged on the rotating element, being thereby essentially perpendicular to the rotation axis of the rotating element and standing thus radially out, like a propeller's wings. In order to assure that the arms, depending on the position of the heald frame, are always able to take the best position provided for by the actuation of the device, it has been foreseen that the arms are stiff in circumferential direction.

According to an advantageous characteristic of the invention, the rotor has, in the area of its rotational axis, an advantageous centrical boring for passing the leno threads. That means that the leno threads can be passed through the rotating element by a boring provided centrically on it, improving thus the thread guiding, particularly with regard to a possible twisting in the area of the boring in the rotor.

More particularly, the arms are arranged on the front side of the rotor of the electromotor, this side facing the material;

hereby each arm is designed as a hook at its ends, whereas the eye for passing the leno threads is provided in the area of the hook-shaped curve. The eye can be provided with inserts that reduce wear and tear of the eye due to the guiding of the leno threads; sleeve-like inserts made or ceramic materials have particularly been thought of.

According to another characteristic of the invention, the electromotor together with the rotor is arranged onto the loom in such a way that the rotational axis runs either parallel or in an angle of up to 90° to the warp threads. Particularly when the angle nearly reaches 90°, the device is optimally bought directly to the material edge so that a leno selvedge can also be executed at the very end of the material. According to still another characteristic of the invention, it may be necessary to arrange further arms accordingly on the opposite front side of the rotor parallel to the arms arranged on the front side facing the material. These additional arms may become necessary in order to guarantee a correct twisting of the leno threads in the area of the feeding of the leno threads from the spools. This is necessary in order to permit to undo the twisting of the leno threads in the same way as they were twisted in the feeding area of the threads from the spools by inverting the rotational direction of the rotor of the electromotor. This difficulty does not arise when the rotor is arranged with its rotational axis parallel to the warp threads of the loom.

BRIEF DESCRIPTION OF THE DRAWINGS

The invention is explained in more details according to the drawings.

DESCRIPTION OF THE PREFERRED EMBODIMENT(S)

Figure 1:
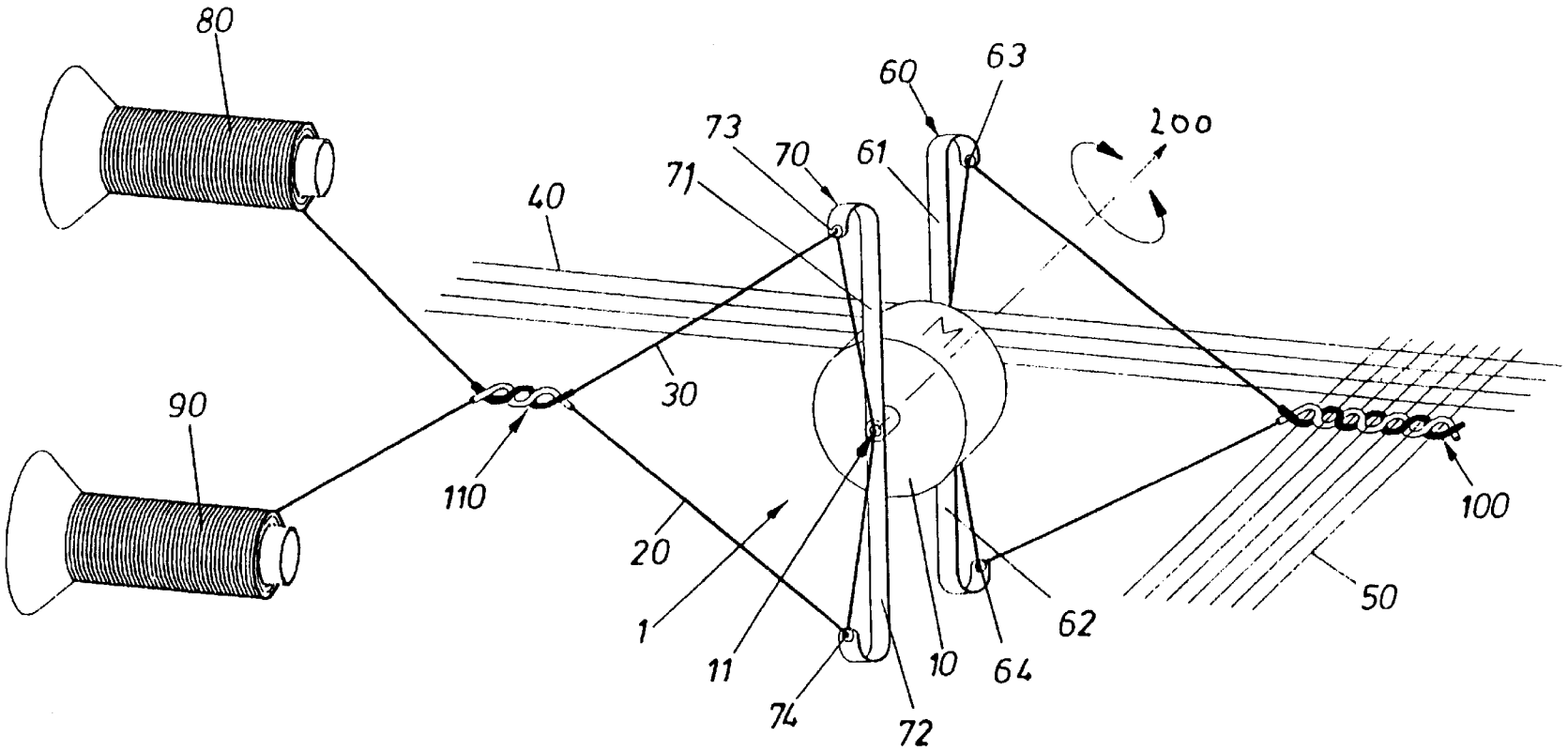
FIG. 1 is a diagram showing the nearly perpendicular arrangement to the material of the device according to the invention, whereas the healds and the reed have been omitted in order to guarantee a greater clearness.
Figure 2:
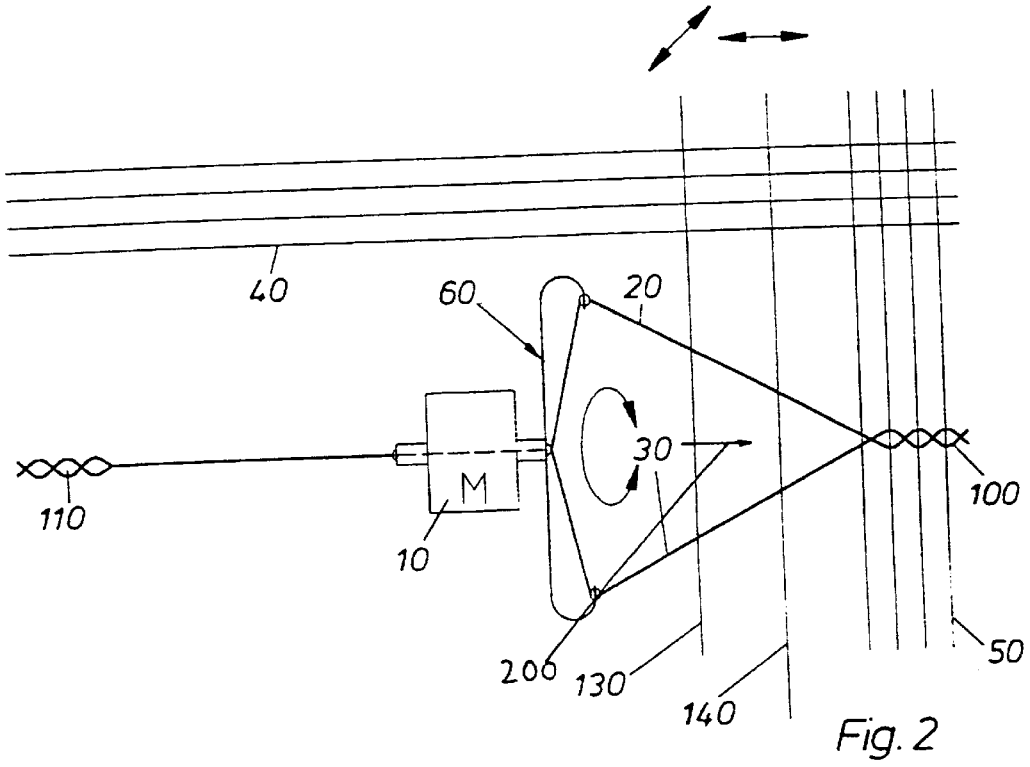
FIG. 2 is a diagram showing the device, the rotational axis of the rotor running parallel to the warp threads.
Figure 3:
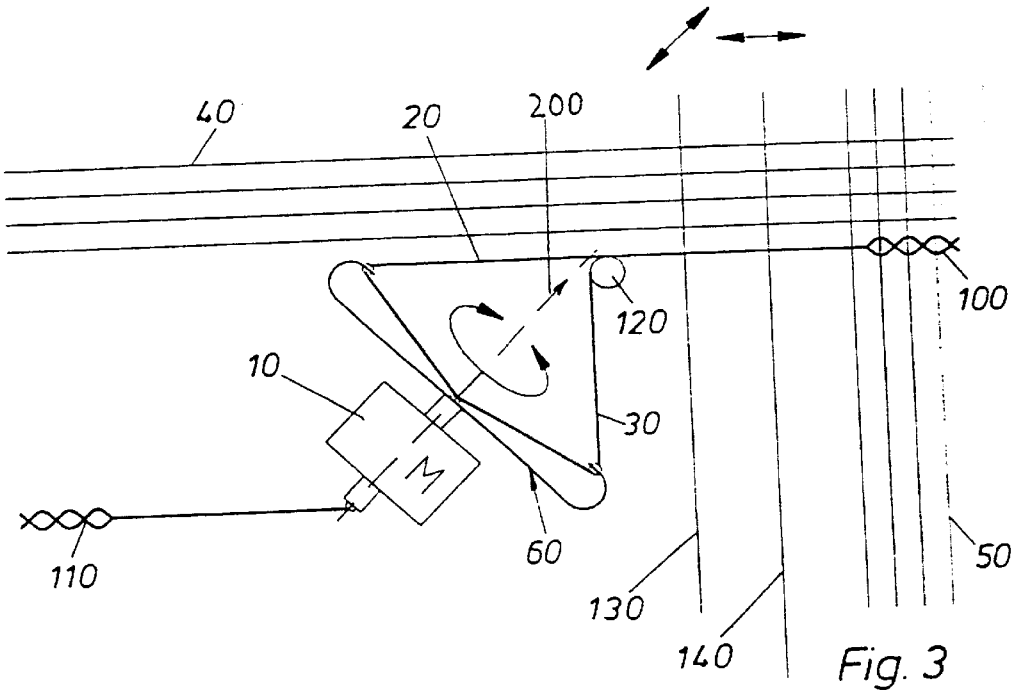
FIG. 3 shows the electromotor with rotor at an angle of approximately 45° to the warp threads.

In the device 1 shown in the FIGS. 1 to 3, a motor referred to as a whole with numeral 10 is provided, which has a centrical boring 11 for passing the leno threads 20, 30. In the embodiment shown in FIG. 1, where the rotational axis is transversal to the warp threads 40, that means that it runs essentially parallel to the weft threads 50, two pairs of arms 60, 70 are provided. Each pair of arms 60, 70 consists of two arms 61, 62 and 71, 72 respectively. The two pairs of arms 60, 70 are running parallel to each other and are fastened each on the front side of the rotor 10, as can clearly be seen on FIG. 1. The arms 61, 62 and 71 72 resp. are hook-shaped and have in the area of the hook-shaped curve the eyes 73, 74 and 63, 64 resp. These eyes serve for passing the leno threads 20, 30, which are unwinded from the thread spools 80, 90.

Moreover, the arms 61, 62 and 71 resp. are designed in axial direction (arrow 200) of the rotating element 10 as being elastic and flexible in order to be able to compensate fluctuations in the thread tension.

Figure 4:
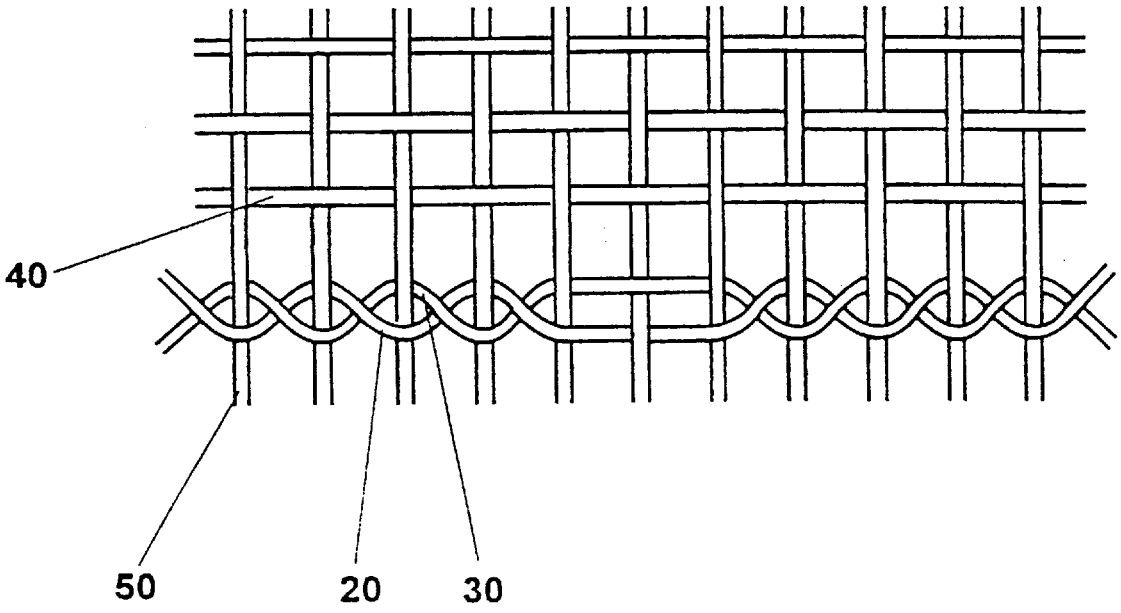
FIG. 4 shows the binding diagram of a full leno selvedge.

When the pairs of arms 60, 70 are rotating, a full leno selvedge 100 is executed in the are of the material (FIG. 4). In the area where the leno threads 20, 30 are fed from the yarn spools 80, 90, the threads (at 110) are also twisted, and untwisted again when the rotating direction of the rotors is reversed after a given number of revolutions in one direction. The weft threads 50 are inserted between the leno threads and prevent the leno selvedge 100 from untwisting. That means that even when twisting 110 is untwisted, on the other side, in the area of the material, another selvedge is executed by twisting with the corresponding weft threads.

The device is working in such a way that the rotor of an electromotor is driven so that its rotation is synchron with the moving of the heald. As an option it is also possible to achieve an early tying by offsetting correspondingly the phases in the synchronisation between the rotational movement of the rotor and the heald movement. That means that such a device is working independently of the heald which is not the case with selvedge machines accommodated on the heald frames.

In the arrangement of the rotational axis running parallel to the warp threads 40 and shown in FIG. 2, where the healds are referred to with numeral 130 and the reed with numeral 140, only little problems naturally occur when the leno threads 20, 30 are fed into the device. In the position of the rotor relative to the material as it is shown in FIG. 2, the spacing form the material is quite big, so that the leno selvedge cannot be arranged directly on the material.

The selvedge can be arranged much nearer to the material when the device is brought into the position according to FIG. 3. Here, the device is positioned at an angle of approximately 45° to the material. Hereby though, a thread guiding element 120 designed as a reel or a roller is provided which makes it possible to guide the threads to the material in order to achieve a correct shed aperture.

The tying which is made with such a device (FIG. 4) is a so-called full leno tying, that means that each weft thread is completely tied off by the tying. Although only three threads are involved, such a selvedge is extremely solid and is not too thick thanks to the use of only three threads, so that the material does not lay thick on the beam in the edge area, and thus does not lose its shape.

What is claimed is:

1. Device for producing a leno selvedge, particularly for a loom, including an electromotor with a rotor, whereas the rotor has at least two spaced guide elements for passing the leno threads, characterized in that the guide elements are designed as arms with eyes at their ends for passing the leno threads, the arms being elastic and flexible in axial direction of the electromotor in order to compensate the thread tensions.

2. Device according to claim 1, characterized in that the arms are stiff in circumferential direction.

3. Device according to claim 1, characterized in that the rotor of the electromotor has a boring in the area of its rotational axis for passing the leno threads.

4. Device according to claim 2, characterized in that the boring for passing the leno threads is arranged centrically in the rotor.

5. Device according to claim 1, characterized in that at least one of said arms is designed at its ends as a hook, whereas the eye is provided in the area of the hook-shaped curve.

6. Device according to claim 1, characterized in that the arms are arranged on the front side of the rotor of the electromotor, this side being directed towards the selvedge.

7. Device according to claim 1, characterized in that further arms are provided on the opposite front side parallel to the arms arranged on the front side facing the selvedge.

8. Device according to claim 1, characterized in that the electromotor together with the rotor is adapted to be arranged onto the loom in such a way that the rotational axis runs either parallel or in an angle of up to 90° to the warp threads.

9. Device according to claim 1, characterized in that the arms are arranged on the rotor, being thereby perpendicular to the rotation axis of the rotor of the electromotor and standing radially out.

10. Device according to claim 1, characterized in that the rotating direction of the rotor is reversible.

* * * * *